United States Patent [19]

Bongenaar et al.

[11] Patent Number: 4,987,337

[45] Date of Patent: Jan. 22, 1991

[54] COLOR DISPLAY TUBE HAVING A COLOR SELECTION ELECTRODE WITH RESILIENT SUPPORT

[75] Inventors: Hendrik Bongenaar; Henricus J. M. van der Avoort, both of Eindhoven, Netherlands

[73] Assignee: U.S. Philips Corporation, New York, N.Y.

[21] Appl. No.: 282,670

[22] Filed: Dec. 12, 1988

[30] Foreign Application Priority Data

Dec. 11, 1987 [NL] Netherlands ..... 8702993

[51] Int. Cl.[5] ..... H01J 29/07

[52] U.S. Cl. ..... 313/406; 313/407

[58] Field of Search ..... 313/404, 406, 407, 405

[56] References Cited

U.S. PATENT DOCUMENTS

| | | | |
|---|---|---|---|
| 4,387,321 | 6/1983 | Gijrath et al. | 313/406 |
| 4,644,222 | 2/1987 | Brunn | 313/406 |
| 4,663,561 | 5/1987 | Brunn | 313/406 |
| 4,763,039 | 8/1988 | Van Rens et al. | 313/406 |

*Primary Examiner*—Kenneth Wieder

*Attorney, Agent, or Firm*—John C. Fox

[57] ABSTRACT

This invention relates to a color display tube having a color selection electrode which is suspended from the display window by means of pin-shaped members which are inserted in the upright edge 3 of a display window. The pin-shaped members have a spherical free end 16 portion which engages in an aperture of a conical portion of the flat resilient suspension element attached to the corners of the mask. To avoid the flat resilient suspension element from lying against the pin-shaped member, the central axis A of the pin-shaped member forms an angle $\alpha$ of from 5° to 20° with the X-Y plane.

5 Claims, 2 Drawing Sheets

COLOR DISPLAY TUBE HAVING A COLOR SELECTION ELECTRODE WITH RESILIENT SUPPORT

BACKGROUND OF THE INVENTION

The invention relates to a colour display tube comprising: an envelope including a neck having an electrode system for generating three electron beams, and a substantially rectangular display window having an upright edge; a display screen of phosphor elements luminescing in different colours on the inside of the, a substantially rectangular colour selection electrode at suspended at a short distance from the display screen and having a large number of apertures which ensure that each electron beam is directed to phosphor elements of one colour; pin-shaped members having a spherical free end portion in the corners of the upright edge of the display window; resilient suspension elements connected to the corners of the colour selection electrode substantially perpendicular to the deflection path of the electron beams to be deflected towards the relevant corner, each resilient suspension element being provided with an at least partly conical portion having an aperture on at least one side of this portion, the aperture engaging the spherical free end portion of the relevant pin-shaped member the resilient suspension element cooperates engaging the and the spherical free end portion and the conical portion having at least three points of contact.

Such a colour display tube is known from EP-A1-0240 077. However, it has been found in practice that such a colour display tube does not always exhibit a satisfactory colour purity.

OBJECTS AND SUMMARY OF THE INVENTION

It is an object of the invention to provide a colour display tube producing a satisfactory colour purity.

To this end, a colour display tube of the type described in the opening paragraph is characterized in that the central axis of each pin-shaped member forms an angle with a plane extending perpendicularly to the tube axis.

The invention is based on the insight that an unsatisfactory colour purity, as sometimes produced by the known colour display tubes, is caused by the resilient suspension element lying against the associated pin-shaped member, which is undesirable in that the position of the colour selection electrode relative to the display screen is not properly defined. In accordance with the invention, by the described angular relationship, the suspension element is prevented from lying against the pin-shaped member. Partly as a result of this the colour display tube has a satisfactory colour purity.

From U.S. Pat. No. 4,387,321, it is known that the central axis of a pin-shaped member having a spherical free end portion extends substantially perpendicularly to the associated flat resilient suspension element. Due to this, the central axis of the pin-shaped member forms an angle with the said plane perpendicular to the tube axis (herein "X-Y plane"), which, dependent on the the electron beam deflection angle of the colour display tube used, for example 90° or 110° ranges between approximately 30° and 50°.

A preferred embodiment of a colour display tube according to the invention is characterized in that the angle is dimensioned such that the central axis of each pin-shaped member is at least substantially perpendicular to the inside surface of the upright edge of the display window. In practice, the upright edge of the display window is not at right angles to the X-Y plane, but instead is slightly inclined outwardly, typically at an angle $\beta$ of about 5° with respect to a plane normal to the X-Y plane. Due to the insight gained from the invention, which consists in arranging a pin-shaped member on the upright edge at an angle to the X-Y plane, it has become possible to arrange a pin-shaped member substantially perpendicularly to this sloping inside surface of the upright edge.

The pin-shaped members can be secured to the upright edge by fusing and in practice it has proved to be very advantageous to fuse the pin-shaped members perpendicularly into the upright edge. In this case only a minimum quantity of glass, from which the upright edge is manufactured, has to be melted, which is advantageous from an enonomical point of view. Moreover, if the pin-shaped members are perpendicularly fused, the force necessary for the fusing operation does not exert a torque on the upright edge. Besides, in the case of a substantially perpendicularly fused pin-shaped member a smaller length of said member than in the case of an obliquely fused pin-shaped member suffices to obtain a proper anchoring in the upright edge. Thus, a saving of material is obtained. To facilitate the fusion of the pin-shaped member, said member should preferably be provided with a shoulder with which the pin-shaped member is pressed into the upright edge.

Another way of providing the pin-shaped member on the upright edge is by means of thermocompression bonding which is advantageous in that the force required to provide the pin-shaped member on the upright edge is smaller than in the case of fusing, so that the pin-shaped member need not be provided with a shoulder. To preclude shearing of the pin-shaped members during thermocompression bonding, it is particularly advantageous to orient them perpendicularly to the upright edge.

A further embodiment of to the invention is characterized in that the conical portion is a separate portion which is located in the aperture of the resilient element, and the conical portion is permanently secured to the associated spherical free end portion and the resilient suspension element, and the central axis of the pin-shaped member forms an angle of at least 5° with the X-Y plane. Due to the fact that the pin-shaped members are provided on the upright edge, the angle, does not exceed 20°. This construction not only provides a colour display tube having a satisfactory colour purity but also a readily conceivable and accurate way of suspending the colour selection electrode in the display window.

An alternative embodiment of a colour display tube according to the invention, in which permanent securing is superflous is characterized in that the aperture of the conical portion of the resilient suspension element is surrounded by an upright edge whose smallest inside diameter is smaller than the largest outside diameter the associated spherical free end portion, and in that the central axis of the pin-shaped member forms an angle of at least 9° with the plane. Due to the provision of the pin-shaped members on the upright edge, the angle, preferably, does not exceed 20°.

BRIEF DESCRIPTION OF THE DRAWINGS

The invention will now be explained in more detail with reference to the drawing, in which.

DESCRIPTION OF THE PREFERRED EMBODIMENTS

Figure 1:
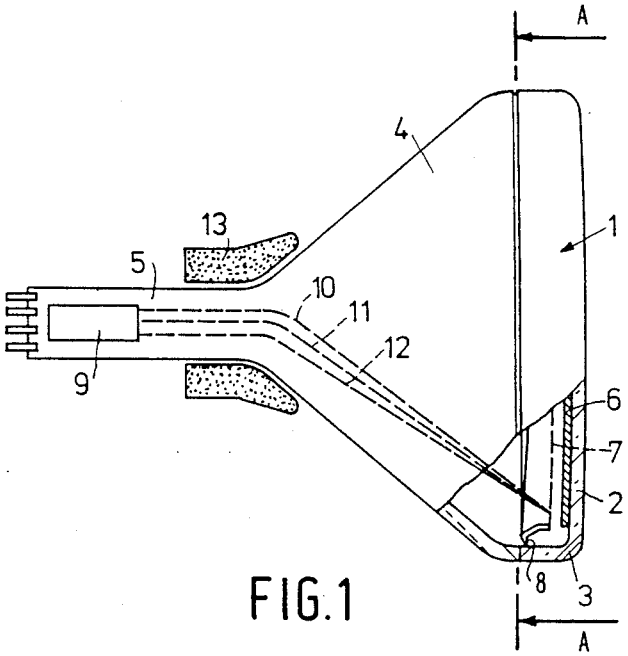
FIG. 1 is a partly sectioned diagrammatic side view of a colour display tube according to the invention.

FIG. 1 is a sectional view of a colour display tube according to the invention. The colour display tube comprises an envelope 1 having a substantially rectangular display window 2 with a peripheral upright edge 3. The colour display tube further comprises a cone 4 and a neck 5. A display screen 6 of phosphor elements luminescing in different colours is provided on the display window 2. A substantially rectangular colour selection electrode 7 having a large number of apertures is suspended at a short distance from the display window 2 by means of suspension means 8 which are located near the corners of the said upright edge 3. An electrode system 9 for generating three electron beams 10, 11 and 12 is mounted in the neck 5 of the colour display tube. These beams are deflected by a coil system 13. The apertures of the colour selection electrode 7 are arranged relative to the luminescing phosphor elements, such that they direct each electron beam to phosphor elements of one colour. Consequently, proper registration the colour selection electrode 7 and the display screen 6 is essential to proper tube operation.

Figure 2:
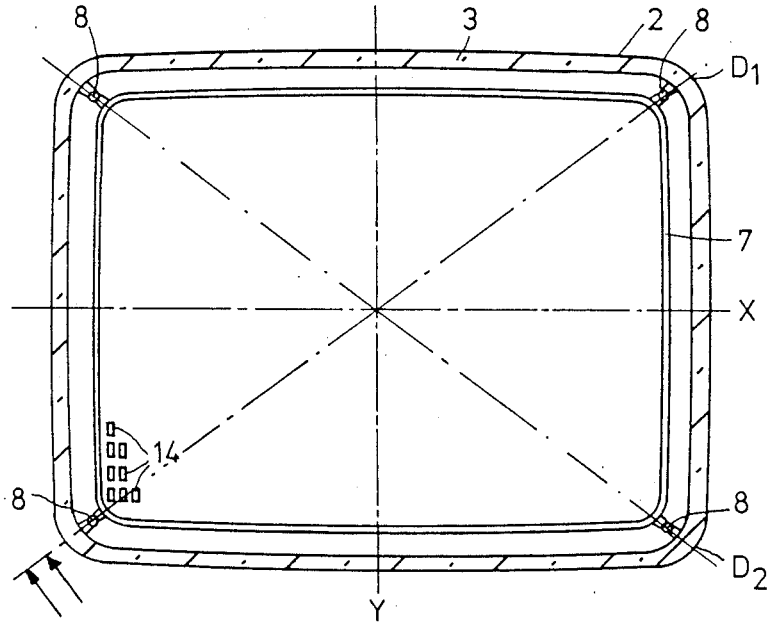
FIG. 2 is a front section along line A—A of the display window with the colour selection electrode viewed from the electrode system

FIG. 2 is a front view of the display window 2 and the colour selection electrode 7 which has a large number of apertures 14, viewed from the electrode system. The x-axis and the y-axis and the diagonals $D_1$ and $D_2$ are depicted in a way which is known to those skilled in the field of display tubes. The tube axis or z-axis, as it is known (not shown in FIG. 2) is perpendicular to the plane formed by the x-axis and the y-axis and intersects the point of intersection of the x-axis and the y-axis. The colour selection electrode 7 is suspended in the display window 2 by suspension means 8 which are located where the diagonals $D_1$ and $D_2$ intersect the upright edge 3 of the display window 2. Each suspension means 8 comprises a resilient suspension element 21 (FIG. 3) which is secured to the colour selection electrode 7, and a pin-shaped member 15 which is arranged in the corner of the upright edge 3. A pin-shaped member is to be understood to mean herein a supporting member having one end portion which can suitably be used for providing the member in the upright edge, and another end portion which can suitably be used for carrying a resilient suspension element.

Figure 3:
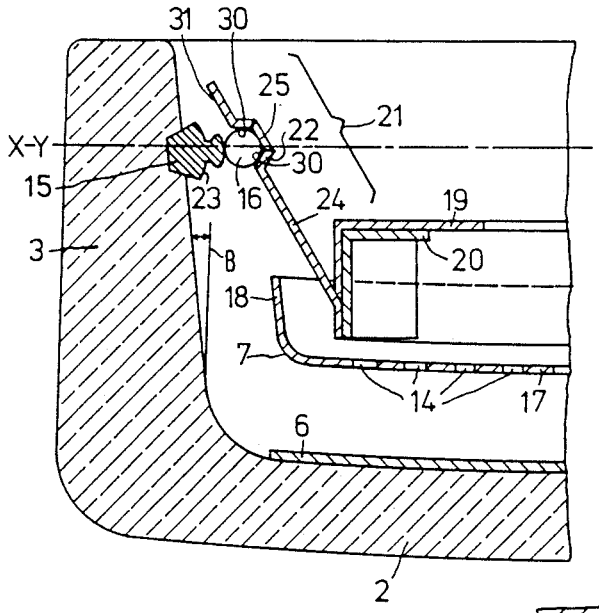
FIG. 3 is a sectional view along diagonal line D, through a corner of the display window including a pin-shaped member.

FIG. 3 is a sectional view of a part of a colour display tube according to the invention, viewed along diagonal line D, from the direction of the arrows shown in FIG. 2. The pin-shaped member 15 has a spherical free end portion 16 and a shoulder 23. The shoulder 23 enables the pin-shaped member 15 to be pressed more readily into the upright edge, which is necessary during the glass fusion operation. The colour selection electrode 7 consists of a thin mask sheet 17 which has a large number of apertures 14 and which is provided with an upright edge 18. A mask frame 19 is attached to the upright edge 18, which mask frame is provide at its corner with a supporting strip 20. The resilient suspension element 21, which in the present example is flat, is secured to this supporting strip 20. The flat resilient suspension element 21 forms an angle with the axis tube 6, which axis extends perpendicularly to the X-Y plane, such that the resilient suspension element is substantially perpendicular to the deflection path of the electron beams which are to be deflected towards the relevant corner of the display window 2. The flat resilient suspension element 21 includes a partly conical portion 22 having an aperture 25, in which the spherical free end portion 16 of the pin-shaped member 15 engages.

The cross-section of the conical portion 22, may be circular or some other shape, e.g., rectangular, so long as the spherical free end portion 16 and the conical portion 22 have at least three points of contact, thereby increasing the rigidity of the construction. Moreover, due to the points of contact, the conical portion 22 is centred relative to the spherical free end portion.

A projecting edge 31 is required to form the conical portion 22 in the flat resilient suspension element 21. To prevent the projecting edge from contacting the pin-shaped member 15, the shoulder 23 being a large problem in this respect, the central axis of the pin-shaped member 15 forms a predetermined angle with the X-Y plane. This is explained in more detail in FIG. 4. The central axis A of the pin-shaped member 15 preferably forms an angle $\alpha$ of at least 5° with the X-Y plane element 21 is clear of the pin-shaped member 15 below which it has been found in practice that due to tolerances occuring both in the manufacture of the pin-shaped member and during fusing, the projecting edge 31 may come to lie against, for example, the shoulder 23. The central axis A of the pin-shaped member 15 is perpendicular to the upright edge 3 of the display window. Perpendicularly fusing the pin-shaped member 15 into the upright edge 3 has advantages as regards the fusion process. For example, in comparison with oblique fusing only a minimal quantity of glass has to be melted, which leads to a rapid and inexpensive fusion process. If the angle $\alpha$ exceeds 20°, the fusion process becomes less advantageous from an economical point of view. Moreover, in the case of perpendicularly fusing a pin-shaped member a smaller length of the member is required than in the case of an obliquely fused pin-shaped member.

Figure 4:
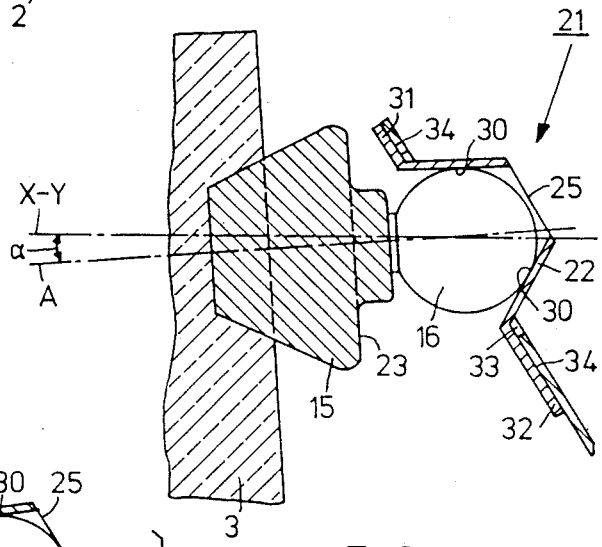
FIG. 4 is a sectional view of a pin-shaped member which is perpendicularly fused into the upright edge of a display window.

In the present embodiment, the conical portion 22 is a separate portion 32 which engages in an aperture 33 of the flat resilient suspension element 21. In the manufacturing process of a colour display tube this separate portion 32 is secured to the flat resilient suspension element, for example, by means of laser spot welding, after the colour selection electrode has been accurately suspended in the display window. In FIG. 4 a few such welds are indicated at 34. After the separate portion 32 is secured to the flat resilient suspension element 21, the colour display tube is subjected to further processing, for example, the display window is provided with a display screen. Finally, the conical portion 22 is secured to the spherical free end portion 16 of the pin-shaped member, for example, by means of laser welding to prevent the conical portion 22 from slipping off the spherical free end portion 16, in the case of blow or shock.

Since the free end portion of the pin-shaped member 15 is spherical, the orientation of the conical portion 22 of the flat resilient suspension element 21 relative to the pin-shaped member has no appreciable influence on the orientation of the color selection electrode. Consequently, the pin-shaped member 15 can be provided on the upright edge 3 at the most favourable angle.

Figure 5:
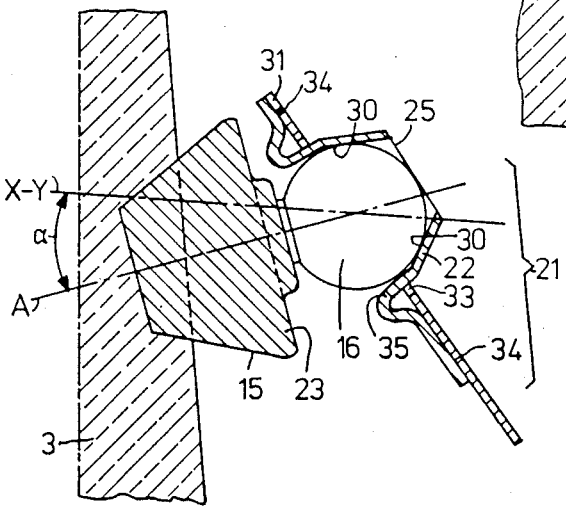
FIG. 5 is a sectional view of a pin-shaped member which is at least substantially perpendicularly fused into the upright edge of a display window

FIG. 5 shows an alternative embodiment of a colour display tube according to the invention, in which the conical portion 22 is not welded to the spherical free end portion 16. Rather, the aperture of the conical portion 22 is surrounded by an upright edge 35 having a smallest inside diameter which is smaller than the largest outside diameter of the associated spherical free end portion 16. To avoid any contact between any portion of the flat resilient suspension element 21, for example the upright edge 35, and the pin-shaped member 15, the central axis A preferably forms an angle $\alpha$ of at least 9° with the X-Y plane. It has been found in practice that due to the tolerances occurring in the manufacture of the upright edge 35, an angle $\alpha$ smaller than 9° can lead to contact. An angle $\alpha$ larger than 20° is less economical and less desirable for the fusion process.

It will be obvious that within the scope of the invention many variations are possible to those skilled in the art. For example, other shapes than those shown herein are possible for the pin-shaped member and for the flat-resilient suspension element, as long as, the pin-shaped member forms an angle with the X-Y plane such that there is no contact with the resilient suspension element.

What is claimed is:

1. A color display tube comprising: an envelope including a neck having an electrode system for generating three electron beams, and a substantially rectangular display window having a peripheral upright edge; a display screen of phosphor elements luminescing in different colors on the inside of the display window; a substantially rectangular color selection electrode suspended at a short distance from the display screen and having a large number of apertures, the apertures of the color selection electrode directing each electron beam to phosphor elements of one color; the tube having its longitudinal axis perpendicular to an X-Y plane; pin-shaped members having a spherical free end portion arranged in the corners of the upright edge of the display window; resilient suspension elements secured to the color selection electrode, which suspension elements are substantially perpendicular to the deflection path of the electron beams to be deflected towards the relevant corner, each resilient suspension element comprising a conical portion defining at least one aperture, the sperical free end portion of each pin-shaped member engaging the aperture of the corresponding resilient element, the spherical free end portion and the conical portion having at least three points of contact;

characterized in that the central axis of the pin-shaped member forms an angle with the X-Y plane.

2. A colour display tube as claimed in claim 1, characterized in that the central axis of the pin-shaped member at least substantially perpendicular to the inside surface of the upright edge of the display window.

3. A colour display tube as claimed in claim 1 in which the central axis of the pin-shaped member forms an angle $\alpha$ of at least 5° with the X-Y plane.

4. A colour display tube as claimed in claim 3, in which the angle does not exceed 20° .

5. A colour display tube as claimed in claim 1, in which the aperture of the conical portion of the resilient element is surrounded by an upright edge having a smallest inside diameter which is smaller than the largest outside diameter of the associated spherical free end portion, and the central axis of the pin-shaped member forms an angle of at least 9° with the plane.

* * * * *